US007591038B2

(12) United States Patent
Murray et al.

(10) Patent No.: US 7,591,038 B2
(45) Date of Patent: Sep. 22, 2009

(54) METHOD AND SYSTEM FOR OPERATING A CLOTHES WASHING MACHINE

(75) Inventors: Peter Murray, Leeds (GB); Joseph G Marcinkiewicz, St. Peters, MO (US); Michael I Henderson, Huby (GB)

(73) Assignee: Emerson Electric Co.,, St. Louis, MO (US)

( * ) Notice: Subject to any disclaimer, the term of this patent is extended or adjusted under 35 U.S.C. 154(b) by 693 days.

(21) Appl. No.: 11/127,634

(22) Filed: May 12, 2005

(65) Prior Publication Data

US 2005/0204482 A1 Sep. 22, 2005

Related U.S. Application Data

(63) Continuation-in-part of application No. 10/655,626, filed on Sep. 4, 2003.

(60) Provisional application No. 60/466,106, filed on Apr. 28, 2003.

(51) Int. Cl.
*D06F 33/02* (2006.01)

(52) U.S. Cl. ..... 8/159; 68/12.08

(58) Field of Classification Search ..... 68/12.08; 8/159

See application file for complete search history.

(56) References Cited

U.S. PATENT DOCUMENTS 2,782,655 A * 2/1957 Stone ..... 68/23.1
2,878,937 A * 3/1959 Worst ..... 210/144
3,422,957 A * 1/1969 Fosler ..... 210/144
6,828,751 B2 * 12/2004 Sadasivam et al. ..... 318/729
7,059,002 B2 * 6/2006 Lee et al. ..... 8/158
7,263,735 B2 * 9/2007 Son ..... 8/159
7,376,998 B2 * 5/2008 Seo et al. ..... 8/159
2003/0046962 A1 * 3/2003 Sonoda et al. ..... 68/12.06
2004/0211009 A1 10/2004 Murray et al.

FOREIGN PATENT DOCUMENTS

EP 0394177 A 10/1990
EP 0657576 A 6/1995
EP 1167610 A 1/2002

OTHER PUBLICATIONS

European Patent Office 1 113 102 Jul. 2001.*

* cited by examiner

*Primary Examiner*—Frankie L Stinson
(74) *Attorney, Agent, or Firm*—Locke Lord Bissell & Liddell LLP

(57) ABSTRACT

A clothes washing machine system and control methods. The washing machine system includes a cabinet having a drum rotatably mounted therein. A motor is coupled to the drum for rotating the drum within the cabinet. A memory device is accessible by a processor, such as a digital signal processor (DSP). The memory contains program code for implementing a method that includes determining the end of the washing machine's spin cycle by monitoring a parameter of the washing machine.

18 Claims, 7 Drawing Sheets

METHOD AND SYSTEM FOR OPERATING A CLOTHES WASHING MACHINE

CROSS REFERENCE TO RELATED APPLICATIONS

This application is a continuation-in-part of U.S. patent application Ser. No. 10/655,626, filed on Sep. 4, 2003, which claims the benefit of U.S. Provisional Patent Application No. 60/466,106, filed on Apr. 28, 2003, both of which are incorporated by reference herein.

BACKGROUND

The present invention relates generally to clothes washing machines, and more particularly, to a method and system for controlling the washing machine drum.

Residential and commercial clothes washing machines are well known. A generally cylindrical drum or basket for holding the clothing and other articles to be washed is rotatably mounted within a cabinet. Typically, an electric motor drives the drum. During is a wash cycle, water and detergent or soap are forced through the clothes to wash them. The detergent is rinsed from the clothes, then during one or more spin cycles the water is extracted from the clothes by spinning the drum.

One way of categorizing washing machines is by the orientation of the washing machine drum. Vertical-axis washing machines have the drum situated to spin about a vertical axis. Articles to be washed are loaded into the drum through a door, which is usually situated on the top of the washing machine. A vertical-axis washing machine drum includes an agitator situated therein, which cleans clothes by pushing and pulling them down into the water. A motor typically drives the agitator, in addition to spinning the vertically-oriented drum during spin cycles. The motor usually operates at a constant speed, and a series of gears or belts are configured to drive the proper component at the proper time during each washing machine cycle.

Horizontal-axis washing machines, having the drum oriented to spin about an essentially horizontal axis, do not include an agitator, and a variable-speed motor drives the drum. During wash cycles, the drum of the horizontal-axis washing machines rotates at a relatively low speed. The rotation speed of the drum is such that clothes are lifted up out of the water, using baffles distributed about the drum, then dropped back into the water as the drum revolves.

Both vertical and horizontal-axis washing machines extract water from clothes by spinning the drum, such that centrifugal force extracts water from the clothes. It is desirable to spin the drum at a high speed and extract the maximum amount of water from the clothes in the shortest possible time. Spin time is reduced, but more power is required to spin at a higher speed. The distribution of the clothes about the periphery of the drum affects the washing machine's ability to spin the drum at a high speed.

If the clothes in the drum are not distributed evenly, the drum will not be able to rotate at an acceptable spin speed without excessive drum vibration in the cabinet. Several factors contribute to drum load unbalance problems. For instance, with vertical-axis washing machines, when a wash or rinse cycle completes and the water is drained from the drum, the clothes are gathered at the bottom of the drum, and are not evenly distributed about the entire drum. Moreover, the drum typically is not perfectly cylindrical; but rather, includes a draft. When the drum spins, the clothes will "creep" up the sides of the drum. However, since a constant speed motor typically drives the vertically-oriented drum, the motor quickly ramps the drum up to the full spin speed. There is little chance for the clothes to distribute about the periphery of the drum, so they creep up the drum's sides in an unbalanced fashion.

The unbalanced, spinning drum vibrates within the cabinet. In conventional vertical-axis washing machines, if the vibration is too severe, the drum will trip a switch mounted inside the cabinet, stopping the drum's rotation and activating a drum-unbalance alarm. A user then manually redistributes the wet clothes within the drum, and restarts the spin cycle.

As discussed above, the drum in a horizontal-axis machine is driven by a variable speed motor. This allows the inclusion of a "distribution" cycle, wherein the drum is rotated faster than the rotation speed of a wash cycle, but slower than in a spin cycle. The drum rotation speed is gradually increased, until the clothes begin to "stick" to the sides of the drum due to centrifugal force. The slower rotation speed allows the clothes to more evenly distribute about the sides of the drum. Once the clothes have been distributed about the drum, the speed is increased to a full spin speed to extract the water from the clothes.

Horizontal-axis washing machines, however, are not immune to drum unbalance problems. If the clothes do not evenly distribute during the distribution cycle, the unbalanced load within the drum will cause unwanted vibrations as the drum rotates. Rather than applying all of the motor's power to spinning the drum at the highest possible speed, power is wasted in drum movement and cabinet vibrations. Detecting the amount of load unbalance allows the spin speed to be optimized to give an efficient wash, while at the same time minimizing the vibrations caused by centrifugal unbalance forces. In cases where the amount of unbalance detected is very high, the washing machine can be programmed to stop its spin cycle, shake the drum to redistribute the washing, and then restart the spin cycle.

Generally, washing machine spin cycles are pre-programmed to run for a fixed duration. In some machines, there may be several pre-programmed spin times stored in memory with the appropriate one being determined by the type of wash selected by the user. When the spin cycle is set to run for a pre-programmed duration, the spin time is likely to be set conservatively in order to ensure that the laundry is spun dry in most possible circumstances. As a result, the spin cycle may last longer than is actually required.

Therefore, it is desirable to automatically detect the end of a spin cycle allows the duration of the spin cycle to be optimized, thus saving time and energy.

SUMMARY

In one aspect of the present disclosure, a clothes washing machine system includes a cabinet having a drum rotatably mounted therein. A motor is coupled to the drum for rotating the drum within the cabinet. A memory device is accessible by a processor, such as a digital signal processor (DSP). The memory device and processor may be separate devices or alternatively the memory device may be embedded with the processor itself, as is the case with a microcontroller. The memory contains program code for controlling operation of the washing machine, including automatically determining the end of the washing machines spin cycle. The motor spins the drum, and a predetermined parameter of the spinning drum is monitored. The drum is stopped in response to the monitored parameter.

In an exemplary implementation, the predetermined parameter is the inertia of the drum and laundry contained in the drum. The parameter, such as inertia, may be monitored discretely or continuously, and the end of the spin cycle may be detected based on the parameter reaching a predetermined value, or the rate of change of the parameter reaching a predetermined level, for example. The predetermined parameter, such as inertia, may be determined using a parameter estimator such as a recursive least squares estimator.

BRIEF DESCRIPTION OF THE DRAWINGS

Other objects and advantages of the invention will become apparent upon reading the following detailed description and upon reference to the drawings in which.

Figure 1:
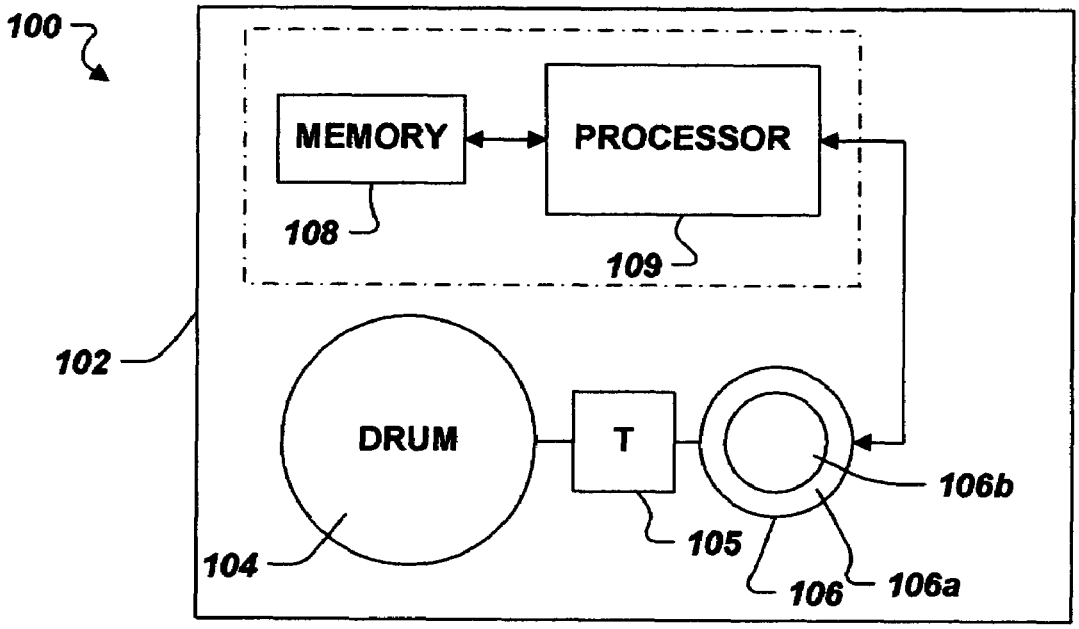
FIG. 1 is a block diagram of a washing machine system in accordance with aspects of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
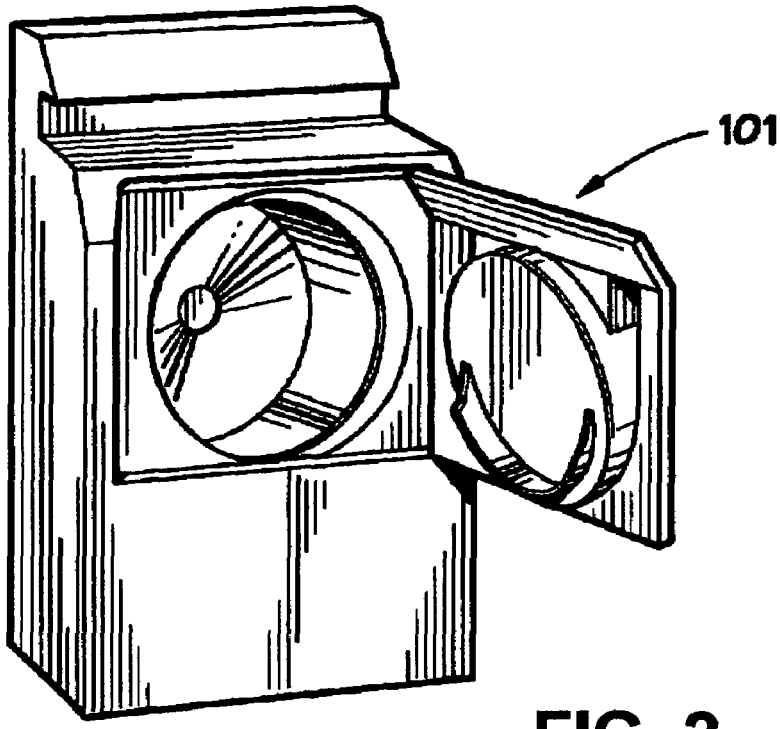
FIG. 2 is a perspective view of an exemplary horizontal-axis washing machine.

FIG. 1 is a block diagram, schematically illustrating a washing machine 100 in accordance with an embodiment of the present invention. The washing machine 100 includes a cabinet 102, in which a drum 104 is rotatably mounted. In one embodiment of the invention, the washing machine 100 is a horizontal-axis washing machine. In other words, the drum 104 is configured to rotate about a substantially horizontal axis within the cabinet 102. FIG. 2 illustrates a horizontal-axis washing machine 101 in accordance with a specific embodiment of the invention.

Referring back to FIG. 1, a motor 106 is operably connected to the drum 104 to drive the drum 104, via some transmission system 105 which could be a belt drive, clutch or direct coupling, for example. The motor 106 includes a stator 106*a* and a rotor 106*b* situated to rotate relative to the stator 106*a*. Any suitable motor type may be employed, including an induction motor, a brushless permanent magnet motor (BPM), a switched reluctance (SR) motor, etc. In one particular exemplary embodiment, a three-phase controlled induction motor (CIM) is used. A processing device 109 controls operation of the motor 106, and a memory device 108 is accessible by the processor 109. The processor 109 may comprise, for example, any suitable type of digital processor such as a digital signal processor (DSP), microcontroller or microprocessor.

Figure 3:
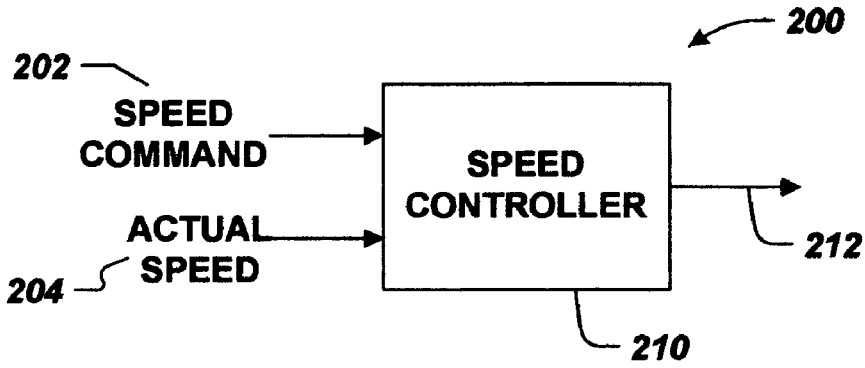
FIG. 3 is a block diagram illustrating an exemplary speed control loop.

The memory 108 stores program instructions executed by the processor 109 for controlling operation of the washing machine system 100. Among other things, the processor 109 is programmed to control the speed of the motor 106 and thus, the drum 104. A typical speed control loop 200 is shown in FIG. 3. A speed command signal 202 and a signal 204 indicating the actual speed of the rotor 106*b* are applied to a speed controller 210, such as a proportional/integral (PI) controller. The speed controller 210 compares the speed demand signal 202 and the actual speed signal 204 to calculate a speed error, and in response thereto, outputs a control signal 212 that varies the application of power to the motor to achieve the desired speed.

Speed/position detection and control of the rotor 106*b* may be implemented, for example, based on feedback from a tachometer on the motor shaft. In other washing machine systems embodying aspects of the present invention, position/speed of the rotor 106*b* is calculated or estimated from monitored parameters of the motor 106, such as the motor's voltage and current. These systems are often called "sensorless" systems since they do not use a physical transducer to determine the position and or speed. In such sensorless systems, the processor 109 receives indications of the motor current and voltage, and an algorithm stored in the memory 108 determines the position/speed of the rotor 106*b* based thereon.

As discussed in the Background section herein above, washing machines typically include a variety of operation cycles. Washing machines—particularly horizontal-axis machines—include one or more wash cycles, distribution cycles and spin cycles. Drum unbalance is rarely a significant problem during wash cycles, which, in a horizontal-axis machine, use a drum rotation speed of about 50 rpm to tumble the clothes in and out of the water. Distribution cycles typically operate at a drum rotation speed of about 55-110 rpm (clothes will begin to "plaster" or "stick" to the sides of the drum 104 at one G of centrifugal force).

In comparison, the minimum rotation speed that is normally considered a "spin cycle" speed is about 250 rpm. For example, a drum rotation speed of about 350-450 may be considered a "low" spin speed, a drum rotation speed of about 650-850 may be considered a "medium" spin speed, and a drum rotation speed of about 1,000 rpm may be considered a "high" spin speed. As discussed above, it is desirable to rotate the drum 104 at a high speed to extract the maximum amount of water from the clothes in the shortest possible time.

Detecting the amount of a load unbalance allows the spin speed to be optimized to give an efficient wash, while at the same time minimizing the vibrations caused by centrifugal unbalance forces. Accordingly, the memory 108 includes program code that when executed by the processor, implements methods to determine an unbalance mass in the rotating drum 104.

Figure 4:
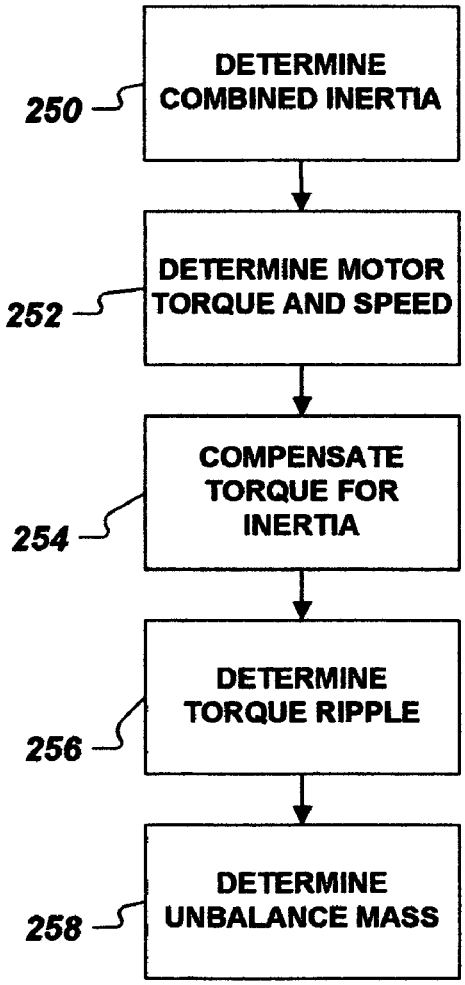
FIG. 4 is a flow diagram summarizing a method of determining an unbalance mass in accordance with the present invention.

An exemplary method for determining the unbalance mass is summarized in FIG. 4. The unbalance mass is determined based on a determination of the motor torque and speed ripple. A measure of the amount of unbalance is determined by using a parameter estimator, such as a recursive least squares (RLS) parameter estimator to calculate the amount of torque ripple. The relationship between torque ripple and unbalance mass is known by constructing a model of the drum load. In certain embodiments, a sensorless motor is employed, in which the motor speed and motor torque are calculated from terminal measurements of the motor's voltage and current. Alternatively, other instrumentation may be used, such as a tachometer, to determine speed.

In block 250 of FIG. 4, the combined drum and wash inertia is estimated. Inertia estimation schemes are described further below. Once the combined inertia has been estimated the motor is commanded to run at a steady speed, which is set such that plastering occurs with minimal movement of the drum on its suspension. As indicated in block 252, the motor torque and speed variables are then read. Other system variables such as acceleration and position can be determined from the motor speed. Additionally, all motor variables can be referred to the drum using a model of the transmission system.

In block 254 the inertial torque caused by any speed ripple is subtracted from the overall torque, which ensures that the remaining torque ripple is due entirely to gravity acting on the unbalanced mass. The inertial torque ripple is calculated from the inertia calculated in block 250 and the speed.

The drum position and compensated torque are then fed into a parameter estimator, which gives an estimate of the torque ripple in block 256. Blocks 252, 254 and 256 are repeated at a plurality of sampling points until the torque ripple estimate converges to a steady value, typically within five drum cycles. In block 258, the unbalance mass is determined based on the torque ripple. The method summarized in FIG. 4 is described in further detail below.

Figure 5:
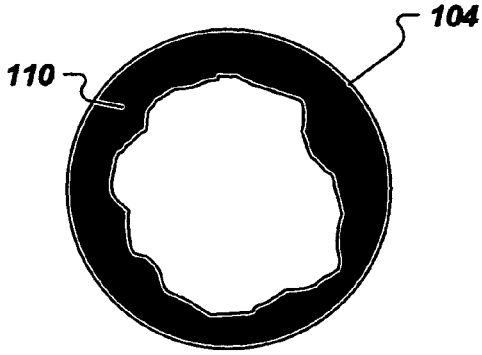
FIG. 5 illustrates laundry distribution in a washing machine drum.
Figure 6:
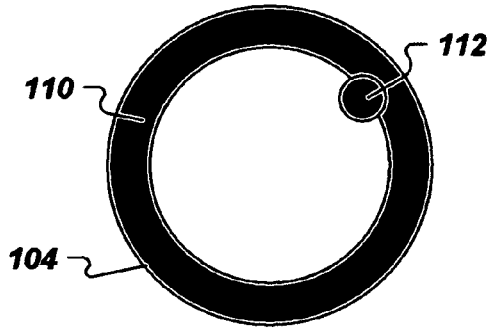
FIG. 6 illustrates laundry distribution including a point mass unbalance in a washing machine drum.

During the washing machine distribution cycle the laundry gets plastered around the periphery of the drum 104 in a random, and essentially unpredictable, manner. The distribution of the laundry 110 will invariably be uneven as shown in FIG. 5. However, the effect of an unevenly distributed wash load on the system is actually equivalent to that of an evenly distributed wash load with a point mass unbalance. Thus, for purposes of this disclosure, the wash load 110 is assumed to be evenly distributed with a point mass unbalance 112 as shown in FIG. 6.

In accordance with aspects of the present invention, a mathematical model of the washing machine system is constructed. Thus, in order to detect drum unbalance it is necessary to identify the system variables that will be affected by drum unbalance. As noted above, these variables include drum/motor torque and drum/motor angular velocity. When unbalance is present, the drum/motor torque and angular velocity have a cyclically varying component at drum frequency (there may be some higher frequency components as well but these are essentially the result of second order effects or "dynamic unbalance"). The amplitude of this cyclically varying component, or ripple, gives a measure of the amount of unbalance present. The added advantage of using these variables to detect unbalance is that both can be estimated using sensorless control, thus eliminating the need for measurement instrumentation.

Accordingly, the dynamic model of the washing machine drum system obtained contains variables such as torque and speed as well as acceleration and drum position, which can be determined from speed and vice versa. The coefficients of the variables in the dynamic model are composite of various system parameters such as unbalance mass, drum inertia and friction coefficients.

Assuming that the variables of the dynamic model can be obtained by sensorless techniques, or even by using onboard instrumentation, a parameter estimator can be employed to determine the coefficients of the variables and hence the required system parameters such as unbalance mass. A suitable parameter estimator for this purpose is a recursive least squares (RLS) estimator.

There is a certain amount of unbalance inherent in an empty drum 104, so the equivalent point mass unbalance 112 will be that of both the empty drum 104 and the laundry 110 combined. There is no advantage in trying to separate drum unbalance 112 from the laundry 110 unbalance because it is both of these unbalances acting together that ultimately results in the observed vibrations of the washing machine.

An exemplary process of constructing the dynamic model of the drum 104 in accordance with one embodiment of the invention is further detailed herein. The first stage in constructing such a model of the drum is to assume that the axis of rotation of the drum is fixed—the drum suspension is ignored. The fixed axis model is then developed in three steps: the first step is to assume that the axis of the drum is horizontal and that drum friction and drag losses are zero; the second step is to include the effects of friction and drag; and finally the third step is to include drum inclination.

Figure 7:
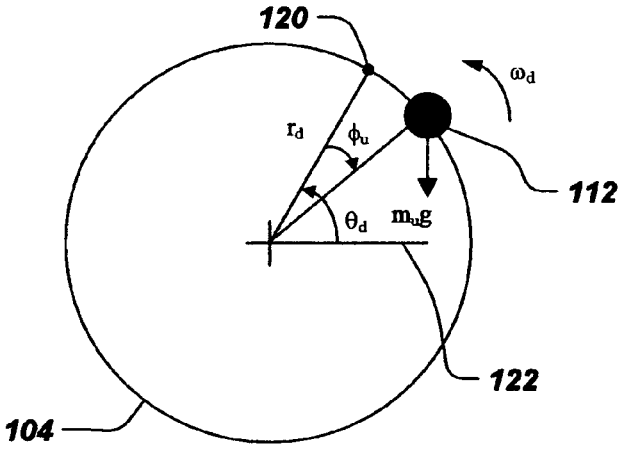
FIG. 7 conceptually illustrates the point mass unbalance in the washing machine drum.

FIG. 7 shows the point mass unbalance 112 on the periphery of the drum 104, which is turning at some angular velocity $\omega_d$. Although the unbalance mass 112 in FIG. 7 is shown to act at the drum radius $r_d$, it will not be assumed that this is always the case, because any distributed laundry will affect the location of the unbalance mass with respect to the center of the drum. The variable $r_u$ is therefore used in the calculations detailed herein to denote the radial distance of the unbalance mass 112 from the center of the drum 104.

Drum position $\theta_d$ is measured in a counterclockwise direction between a reference point 120 on the drum 104 and a fixed datum 122, which is arbitrarily chosen to be at 3 o'clock. The location of the point mass unbalance 112 is given by $\phi_u$ with respect to the drum reference point 120 in a clockwise direction. The position of the point mass unbalance 112 with respect to the fixed datum 122 is therefore $(\theta_d-\phi_u)$. FIG. 7 additionally shows the force on the unbalance mass 112 due to gravity $m_u g$.

Assuming for the moment that there are no friction and drag losses associated with the drum 104, the drum torque $\tau_d$ in the direction of motion is given by:

$$\tau_d = m_u \cdot g \cdot r_u \cdot \cos(\theta_d - \phi_u) + J_d \cdot P(\omega_d) \quad (1)$$

where $J_d$ is the combined inertia of the drum and the unbalance mass and p is a differential operator, d/dt.

It can be seen from Equation 1 that if the velocity $\omega_d$ were constant, i.e. uniform circular motion, the drum torque $\tau_d$ would vary cyclically with a mean value of zero. Therefore, for the fixed speed case Equation 1 reduces to:

$$\tau_d = m_u \cdot g \cdot r_u \cdot \cos(\theta_d - \phi_u)$$

In practice there will be some variation in drum velocity $\omega_d$, depending upon the response of the system's speed controller 210 implemented by the processor 109. If the response of the speed controller 210 is very sluggish, the torque $\tau_d$ will be constant and zero. Therefore, for the fixed (and zero) torque case Equation 1 reduces to:

$$-m_u \cdot g \cdot r_u \cdot \cos(\theta_d - \phi_u) = J_d \cdot p(\omega_d)$$

Figure 8:
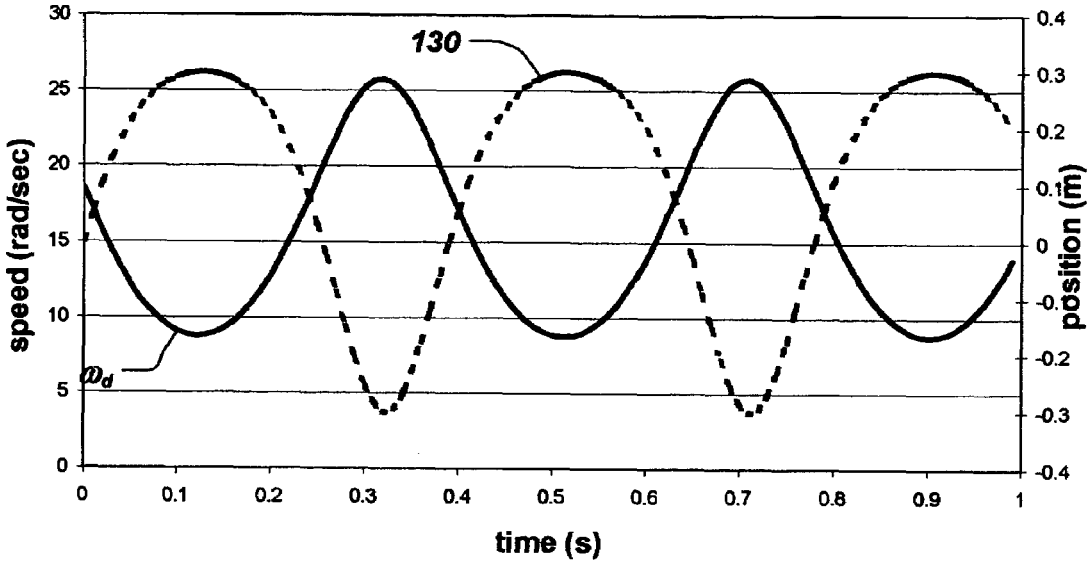
FIG. 8 is a graph illustrating washing machine drum velocity variation with time and the position of an unbalance mass with respect to the center of the drum.

FIG. 8 shows the drum velocity $\omega_d$ variation with time, along with the vertical (y-axis) position 130 of the unbalance mass 112 with respect to the center of the drum 104. The parameters used to obtain these curves were as follows: unbalance mass $m_u$=0.5 kg; $r_u$=0.3 m; $\omega_{d(initial)}$=20 rad/s; $J_d$=0.01 kgm$^2$. These parameters are not necessarily representative of an actual drum with unbalance. Rather, they were chosen for illustrative purposes only. It can be seen that the unbalance mass 112 moves quickly through its nadir, and slowly as it passes through its zenith.

As the mean velocity of the drum $\omega_d$ increases, the magnitude of the speed ripple decreases—as can be seen by considering the energy system:

$$m_u \cdot g \cdot 2 \cdot r_u = \frac{1}{2} \cdot J_d \cdot (\omega_{d(max)}^2 - \omega_{d(min)}^2)$$

where the left side of the equation is the potential energy gained due to gravity in moving the unbalanced mass 112 from the bottom to the top of the drum 104. The right side is the gain in kinetic energy in accelerating the unbalance mass 112 from $\omega_{d(min)}$ to $\omega_{d(max)}$, where $\omega_{d(min)}$ is the angular velocity of the drum 104 when the unbalance mass 112 is at the top of the drum 104 and $\omega_{d(max)}$ is the angular velocity of the drum 104 when the unbalance mass 112 is at the bottom of the drum 104.

In practice, both torque and velocity will vary, and so the observed behavior of the system will lie somewhere between the two extremes outlined above. The amount of torque and speed ripple will depend upon the response of the speed control loop 200, which in turn usually depends upon the proportional and integral gains of the speed controller 210. Therefore, the two cases considered are not appropriate for developing the system model, so the general equation given by Equation 1 is used from here onwards. However, it is important to consider the two extremes to understand that speed and torque ripple are affected by the response of the speed loop, and not just the unbalance mass 112.

In practice, a certain amount of torque is required to keep the drum running at a given speed in order to overcome forces due to drum friction and wind drag. Two types of friction will be considered: coulomb and viscous friction. Coulomb friction is a constant and is therefore independent of speed, although its polarity depends on the direction of rotation of the drum. Viscous friction, on the other hand, is proportional to the angular velocity of the drum. Both of these frictional forces take into account the resistance to motion due to the bearings, lubrication and wind drag, where the latter is assumed to be a type of viscous friction.

The coulomb friction is given by $\tau_c \text{signum}(\omega_d)$, where $\text{signum}(\omega_d)$ denotes that its polarity is the same as that of the drum's angular velocity, and the viscous friction is given by $B_d \cdot \omega_d$, where $B_d$ is the drum's viscous friction coefficient. Expanding Equation 1 to include these frictional forces gives:

$$\tau_d = m_u \cdot g \cdot r_u \cdot \cos(\theta_d - \phi_u) + J_d \cdot p(\omega_d) + B_d \cdot \omega_d + \tau_c \, signum(\omega_d) \quad (2)$$

Figure 9:
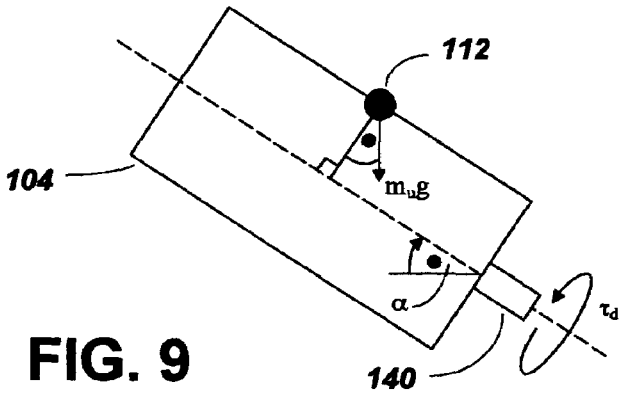
FIG. 9 is a side view of a washing machine the drum inclined relative to the horizontal.

The drum 104 in some versions of "horizontal" axis washing machines is not actually horizontal, but rather, is inclined at some angle to the horizontal. FIG. 9 shows a side view of the drum 104 inclined at an angle $\alpha$ to the horizontal. The gravitational force acting on the unbalanced mass 112 is $m_u g$. However, because the drum 104 is inclined at an angle $\alpha$ to the horizontal, the force perpendicular to the shaft 140 is given by:

$$\text{Force} = m_u \cdot g \cdot \cos(\alpha)$$

Figure 10:
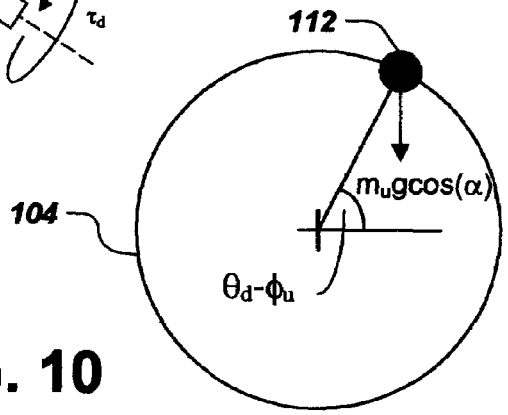
FIG. 10 illustrates the washing machine and point mass unbalance shown in FIG. 7, including the effects of drum inclination.

The drum 104 illustrated in FIG. 7 is redrawn in FIG. 10 to include the effects of drum inclination as shown in FIG. 9.

Equation 2 can now be modified to include drum inclination as follows:

$$\tau_d = m_u \cdot g \cdot r_u \cdot \cos(\alpha) \cdot \cos(\theta_d - \phi_u) + J_d \cdot p(\omega_d) + B_d \cdot \omega_d + \tau_c \cdot signum(\omega_d) \quad (3)$$

Note that if $\pi$=90°, the gravitational force on the unbalance mass 112 acts along the axis of the shaft 140 and therefore has no effect on shaft torque.

Figure 11:
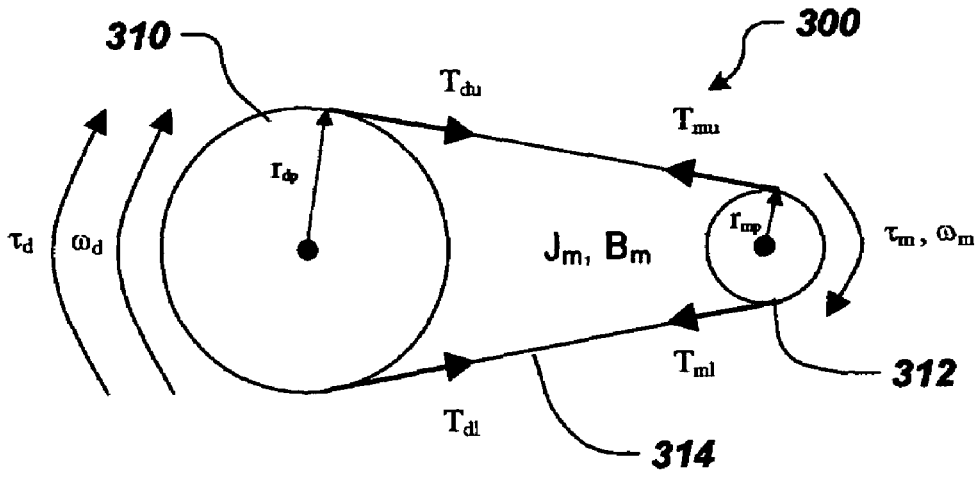
FIG. 11 conceptually illustrates a belt and pulley transmission system for driving a washing machine drum.

Referring back to FIG. 1, a motor 106 is operably connected to the drum 104 to drive the drum via a transmission system 105. In order to refer system variables, such as torque and speed, between the motor and drum, it is necessary to construct a model of the transmission system 105. FIG. 11 conceptually illustrates portions of a typical belt and pulley transmission system 300 for driving a washing machine drum. The transmission system 300 includes a drum pulley 310 connected to a motor pulley 312 by a belt 314.

In developing the unbalance detection system, assumptions for the washing machine transmission 300 system include the following:

1. The top or bottom of the belt 314 is either fully tensioned or fully slack.
2. The belt 314 does not appreciably slip.
3. There is no belt 314 compliance, i.e. the belt 314 does not stretch.
4. There is no backlash.

Based on FIG. 11, the electro-dynamic equation for the motor is as follows:

$$\tau_m = J_m \cdot p(\omega_m) + B_m \cdot \omega_m + (T_{mu} - T_{m1}) \cdot r_{mp} \quad (4)$$

where $J_m$ is the motor pulley 312 inertia, $B_m$ is the motor viscous friction coefficient, $T_{mu}$ and $T_{m1}$ are the upper and lower belt tension, respectively, at the motor pulley 312, $r_{mp}$ is the radius of the motor pulley 312, and $\omega_m$ is the motor shaft speed. The torque applied to the drum pulley 310, $\tau_d$, is given by:

$$\tau_d = (T_{du} - T_{d1}) \cdot r_{dp} \quad (5)$$

where $T_{du}$ and $T_{d1}$ are the upper and lower belt tension, respectively, at the drum pulley 310 and $r_{dp}$ is the radius of the drum pulley 310. As noted above in assumption 2, it is assumed that the top or bottom of the belt 314 is either fully tensioned or fully slack. This leads to the following:

$$T_{m1}=T_{d1}=0 \tag{6}$$

$$T_{mu}=T_{du} \tag{7}$$

Therefore, combining Equations 4 and 5 gives:

$$\tau_d = \frac{r_{dp}}{r_{mp}}(\tau_m - J_m \cdot p(\omega_m) + B_m \cdot \omega_m) \tag{8}$$

Assuming a perfect transmission system, the drum speed and motor speed are related as follows:

$$\omega_m = \frac{r_{dp}}{r_{mp}} \cdot \omega_d \tag{9}$$

Equation 8 can therefore be written in terms of drum speed as follows:

$$\tau_d = \frac{r_{dp}}{r_{mp}} \cdot \tau_m - \left(\frac{r_{dp}}{r_{mp}}\right)^2 \cdot (J_m \cdot p(\omega_d) + B_m \cdot \omega_d) \tag{10}$$

From the fixed axis model, it can be seen that $\tau_d$ contains the terms $J_d \cdot p(\omega_d)$ and $B_d \cdot \omega_d$, which are similar to the inertial and viscous terms as those in Equation 10. The drum and motor inertial and viscous terms combine to give:

$$\left(J_d + \left(\frac{r_{dp}}{r_{mp}}\right)^2 \cdot J_m\right) \cdot p(\omega_d) \text{ and } \left(B_d + \left(\frac{r_{dp}}{r_{mp}}\right)^2 \cdot B_m\right) \cdot \omega_d$$

Now, $$\text{if } J_d \gg \left(\frac{r_{dp}}{r_{mp}}\right)^2 \cdot J_m \text{ and } B_d \gg \left(\frac{r_{dp}}{r_{mp}}\right)^2 \cdot B_m,$$

Equation 10 simply reduces to:

$$\tau_d = \frac{r_{dp}}{r_{mp}} \cdot \tau_m \tag{11}$$

The fixed axis model given by Equation 3 is referred to the drum, i.e. torque and speed are both drum quantities. However, it is more likely that the torque and speed variables that form the input to the model will be motor quantities, so Equations 9 and 11 will be required to refer motor speed and torque to the drum.

In order for the fixed axis model to be valid, the drum must not move significantly on its suspension. Therefore when using this model unbalance detection must be carried out when the drum is above minimum plaster speed, but less than the speed at which the suspension has a significant impact. Accordingly, in embodiments of the invention, the drum is run at a predetermined speed, such as 100 rpm, for some time period while the unbalance detection is implemented. Even if the drum is commanded to run at a predetermined constant speed, there will be some speed ripple that will result in a small amount of torque ripple due to the viscous friction term, $B_d$. However, if this torque ripple component is assumed negligible and the speed is otherwise substantially constant, the fixed axis model given by Equation 3 reduces to:

$$\tau_d=m_u \cdot g \cdot r_u \cdot \cos(\alpha) \cdot \cos(\theta_d-\phi_u)+J_d \cdot p(\omega_d)+\tau_{mean} \tag{12}$$

In order for a unique set of parameters to be estimated for the fixed axis system, the input signal must be sufficiently exciting. This requirement will be met if the input signal excites all modes of the system; such a signal is said to be "persistently exciting." For the system considered here, the input signal is effectively the drum speed, $\omega_d$, as the other variables, i.e. $\theta_d$ and $p(\omega_d)$, are themselves determined by the drum speed and vice versa.

During unbalance detection the drum will be commanded to run at a constant speed. If the actual drum speed is perfectly constant during this time there will be no angular acceleration of the drum, i.e. $p(\omega_d)=0$. Under this mode of operation the inertia has no effect on the drum torque so it would not be possible for the parameter estimator to get an estimate of the drum inertia, $J_d$. However, in practice the speed controller 210 will not be capable of regulating the drum speed to a perfectly constant value and there will be some speed variation of the drum about the commanded speed 202.

Test results show that, at speeds pertaining to a fixed axis system, the speed ripple is approximately sinusoidal at a frequency corresponding to drum speed. At small levels of speed ripple, the unbalance torque will be approximately sinusoidal because $\cos(\omega_d \cdot t-\phi_u) \approx \cos(\overline{\omega}_d \cdot t-\phi_u)$, where $\overline{\omega}_d$ is the mean speed. This causes a problem because when the frequency of the speed ripple is the same as the mean drum speed, the inertial torque will be sinusoidal at the same frequency as the unbalance torque. Under these circumstances numerous combinations of $J_d$, $m_u$ and $\phi_u$ will result in a small estimator error and as such, the estimator may have difficulty in uniquely identifying the inertial and unbalance torque components from the overall drum torque (At larger values of speed ripple this becomes less of a problem because $\cos(\omega_d \cdot t-\phi_u) \neq \cos(\overline{\omega}_d \cdot t-\phi_u)$ and so the unbalance torque contains harmonic components, whereas the inertial torque is still sinusoidal. The parameter estimator can then more easily distinguish between the inertial and unbalance components of torque).

If the drum inertia is known before unbalance detection is carried out, the problem described above can be eliminated by compensating the drum torque for inertia. Assume for the moment that the drum inertia is known before unbalance detection is carried out. This being the case, the constant speed fixed axis model can be written as:

$$\tau_{d_comp}=m_u \cdot g \cdot r_u \cdot \cos(\alpha) \cdot \cos(\theta_d-\phi_u)+\tau_{mean}$$

where $\tau_{d_comp}=\tau_d-J_d \cdot p(\omega_d)$

Therefore, if the drum inertia is known, the inertial torque ripple can be subtracted from the overall ripple so that the input to the estimator is just simply the torque ripple due to gravity acting on the unbalance mass, plus the mean. Expanding the $\tau_{d_comp}$ gives:

$$\tau_{d_comp}=m_u \cdot g \cdot r_u \cdot \cos(\alpha) \cdot \cos(\phi_u)\cos(\theta_d)+m_u \cdot g \cdot r_u \cdot \cos(\alpha) \cdot \sin(\phi_u)\sin(\theta_d)+\tau_{mean}$$

The above equation can be written in the following form suitable for Parameter Estimators such as the RLS estimator:

$$y = x^T\theta$$

where:

$$y = \tau_{d_comp}$$

$$x^T = [1 \ \cos\theta_d \ \sin\theta_d]$$

$$\theta = \begin{bmatrix} \tau_{mean} \\ m_u \cdot g \cdot r_u \cdot \cos\alpha \cdot \cos\phi \\ m_u \cdot g \cdot r_u \cdot \cos\alpha \cdot \sin\phi \end{bmatrix} = \begin{bmatrix} P_1 \\ P_2 \\ P_3 \end{bmatrix}$$

and $P_{1\text{-}3}$ are the parameters, or coefficients, estimated by the PE.

It can be seen from the parameter matrix, θ, that further manipulation of $P_2$ and $P_3$ is required to extract the peak torque ripple and the torque ripple phase lag. This is done as follows:

$$\phi_u = \tan^{-1}\left(\frac{P_3}{P_2}\right)$$

$$m_u = \frac{P_3}{g \cdot r_u \cdot \cos\alpha \cdot \sin\phi_u} \text{ or } \frac{P_2}{g \cdot r_u \cdot \cos\alpha \cdot \cos\phi_u}$$

If the acceleration is calculated from drum position, rather than speed, it is essential that the drum position be filtered. The reason for this is that the acceleration is obtained by differentiating the drum position twice. A small amount of noise on the drum position signal could result in very noisy acceleration data, which could in turn affect the accuracy of the estimated parameters. (However, if the speed is known the problem is not as severe because only one differentiation is required to calculate the acceleration; drum position in this case is determined by integrating the speed.)

Being a sawtooth waveform, the drum position signal contains high frequency components not associated with noise. Therefore, applying a low pass filter directly to the drum position signal will distort it significantly. To avoid these problems the sine and cosine of the signal is filtered and then the filtered drum position is reconstructed as follows:

$$\theta_{d_filtered} = \tan^{-1}\left(\frac{(\sin\theta_d)_{filtered}}{(\cos\theta_d)_{filtered}}\right)$$

Figure 12:
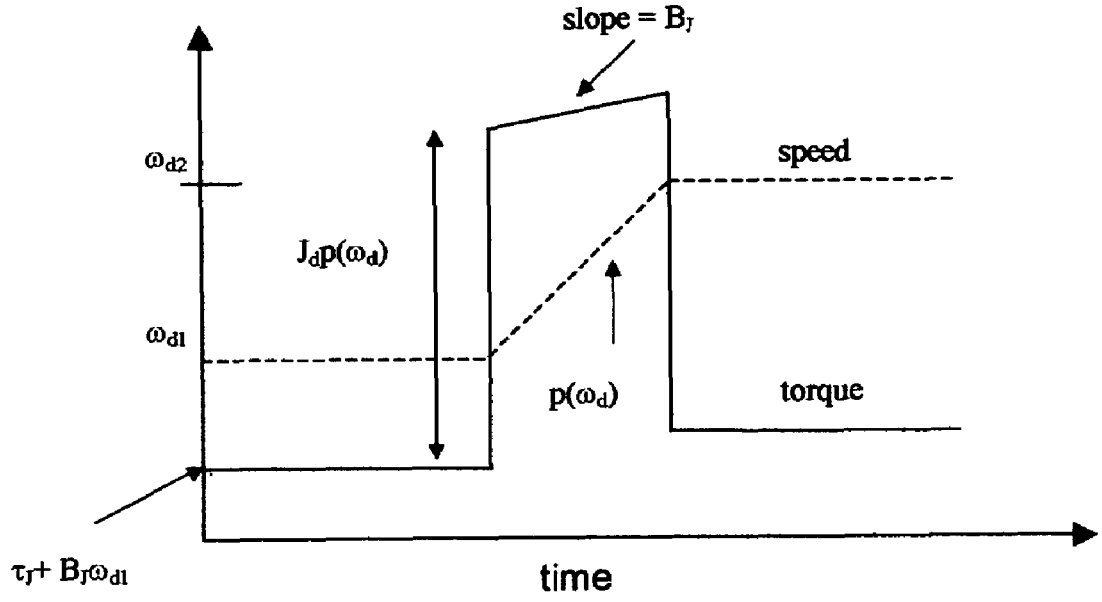
FIG. 12 illustrates torque and speed profiles resulting from accelerating a washing machine drum from a first speed to a second speed for determining drum inertia in accordance with aspects of the present invention.

In the embodiment described above, the drum inertia is calculated prior to the unbalance determination. One method of calculating the inertia is to ramp the drum speed from one predetermined speed to another, for example, 100 rpm to 200 rpm, and feed the resulting data into a parameter estimator with $J_d$ as a tractable parameter. The torque and speed profiles will then look as shown in FIG. 12, which assumes a linear ramp in speed (though a linear ramp is not a requirement). Note that for reasons of clarity, FIG. 12 does not illustrate the torque or speed ripple.

In accelerating from $\omega_{d1}$ to $\omega_{d2}$, it is likely that the suspension will start to affect the mean torque and torque ripple. However, these suspension effects are not taken into account by the fixed axis model given by Equation 2. In calculating the inertia only, the change in torque ripple due to suspension effects is not of much importance. However, the change in mean torque as the speed is increased will affect the inertia calculation, but can be modeled as an additional viscous friction term, $B_s$, if it is assumed that the change in mean torque between $\omega_{d1}$ to $\omega_{d2}$ is a reasonably linear function of speed. Moreover, this additional viscous term can be lumped together with the actual viscous friction term.

Assuming that the mean torque varies linearly with speed between $\omega_{d1}$ and $\omega_{d2}$, the profile shown in FIG. 12 can be modeled using the following equation:

$$\tau_d = J_d p(\omega_d) + B_J\omega_d + \tau_J \tag{13}$$

where $B_J = B_s + B_d$ and $\tau_J \neq \tau_c$

Although torque ripple is not that important as far as estimating inertia is concerned—at least when using a speed profile such as that in FIG. 12—better results will be achieved from a Parameter Estimator if a sinusoidal torque ripple component is included in the model. The reason for this is that the Parameter Estimator may initially perceive the torque ripple as being a sinusoidal variation in mean torque. The torque ripple component will be of the same form as that of the fixed axis model. Therefore, with torque ripple included the inertia model becomes:

$$\tau_d = J_d p(\omega_d) + B_J\omega_d + \tau_J + A\cdot\cos\theta_d + B\cdot\sin\theta_d \tag{14}$$

where A and B are constants. Re-arranging Equation 14 into the form $y = x^T\theta$ for parameter estimation yields:

$$y = \tau_d$$

$$x^T = [p(\omega_d)\omega_d \ 1 \cos\theta_d \sin\theta_d]$$

$$\theta = \begin{bmatrix} J_d \\ B_J \\ \tau_J \\ A \\ B \end{bmatrix} = \begin{bmatrix} P_1 \\ P_2 \\ P_3 \\ P_4 \\ P_5 \end{bmatrix}$$

$P_{1\text{-}5}$ are the parameters estimated by the parameter estimator. If the drum moves on its suspension significantly the torque ripple will change and so, therefore, will the A and B coefficients. As a result the estimator parameters P4 and P5 will also change in an attempt to track the changes in A and B. This is acceptable because in this particular embodiment only the inertia parameter $P_1$ is required and this is not affected significantly by a gradual change in torque ripple when using a speed profile such as that in FIG. 12. The inertia is therefore directly accessible and is simply the parameter $P_1$.

Figure 13:
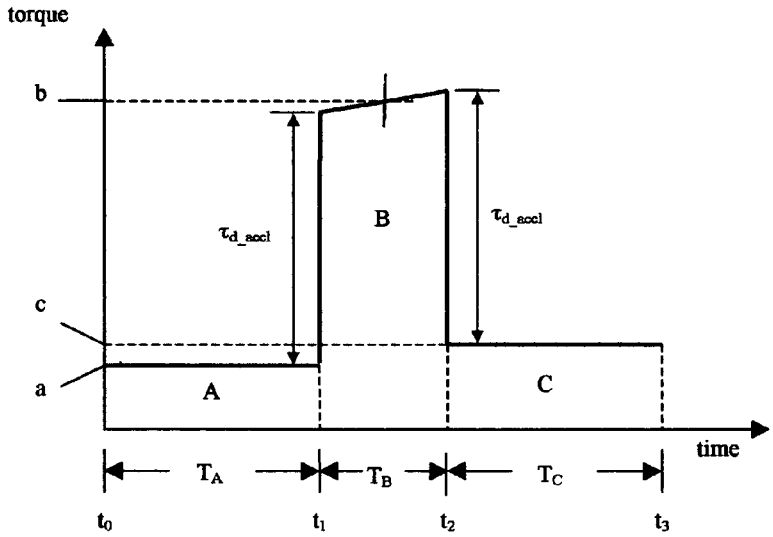
FIG. 13 illustrates a torque profile resulting from accelerating a washing machine drum from a first speed to a second speed for determining drum inertia in accordance with further aspects of the present invention.

In another exemplary embodiment of the invention, an alternative inertia calculation is employed that requires the drum be linearly accelerated from a first predetermined speed to a second higher speed, but does not require the use of a parameter estimator. As noted above, at around minimum plaster speed there is very little suspension movement and one can assume a fixed axis model. However, as the drum is accelerated beyond the minimum plaster speed, the effects of the suspension will become noticeable If the ripple component of the torque waveform is removed, the resulting trace looks something like that shown in FIG. 13. The main quantity of interest in FIG. 13 is the step increase in torque at the onset of acceleration (or the step decrease in torque at the end of acceleration), $\tau_{d_accl}$. Once $\tau_{d_accl}$ is determined, the drum inertia, $J_d$, can then be calculated as follows:

$$J_d = \frac{\tau_{d_accl}}{p(\omega_d)}$$

The calculation of $\tau_{d_accl}$ follows. The torque trace in FIG. 13 is split up into three distinct regions: A, B and C. The average torque in each of these regions is given by a, b and c, which are calculated as follows:

$$a = \frac{1}{T_A}\int_{t_0}^{t_1} \tau_d \, dt$$

$$b = \frac{1}{T_B}\int_{t_1}^{t_2} \tau_d \, dt$$

$$c = \frac{1}{T_C}\int_{t_2}^{t_3} \tau_d \, dt$$

The acceleration torque is then given by:

$$\tau_{d_accl} = b - \frac{(c+a)}{2}$$

FIG. 13 shows the torque trace with the ripple component removed. This method is applicable with torque ripple present, provided that each region contains an integer number of ripple cycles. The periods $T_A$, $T_B$ and $T_C$ must therefore be chosen carefully to ensure this is the case. However, the greater the number of ripple cycles in each region there are, the less critical it is to have an integer number of cycles.

The processor implementation for an exemplary embodiment is detailed below. Discretising the integration process yields the following equations for a, b and c:

$$a = \frac{T_s}{T_A} \cdot \sum_{n=1}^{(t_1-t_0)/T_s} \tau_{d(n)}$$

$$b = \frac{T_s}{T_B} \cdot \sum_{n=1}^{(t_2-t_1)/T_s} \tau_{d(n)}$$

$$c = \frac{T_s}{T_C} \cdot \sum_{n=1}^{(t_3-t_2)/T_s} \tau_{d(n)}$$

The acceleration torque is therefore given by:

$$\tau_{d_accl} = T_s \cdot \left( \frac{1}{T_B} \cdot \sum_{n=1}^{(t_2-t_1)/T_s} \tau_{d(n)} - \frac{1}{2 \cdot T_A} \cdot \sum_{n=1}^{(t_1-t_0)/T_s} \tau_{d(n)} - \frac{1}{2 \cdot T_C} \cdot \sum_{n=1}^{(t_3-t_2)/T_s} \tau_{d(n)} \right)$$

The inertia ($kg \cdot m^2$) is then given by:

$$J_d = \frac{T_s \cdot \left( \frac{1}{T_B} \cdot \sum_{n=1}^{(t_2-t_1)/T_s} \tau_{d(n)} - \frac{1}{2 \cdot T_A} \cdot \sum_{n=1}^{(t_1-t_0)/T_s} \tau_{d(n)} - \frac{1}{2 \cdot T_C} \cdot \sum_{n=1}^{(t_3-t_2)/T_s} \tau_{d(n)} \right)}{p(\omega_d)}$$

In some applications it may be possible to accelerate the drum from $\omega_{d1}$ to a suitably higher speed, $\omega_{d2}$, without exciting the suspension significantly—particularly if $\omega_{d1}$ is set to be the minimum plaster speed. If this is the case then another embodiment of the invention is possible whereby the inertia and unbalance mass can be calculated simultaneously, thus eliminating the need to calculate inertia and mass independently as described in the above embodiment. There is also no need to perform inertia compensation. In this embodiment the generalized fixed axis model given by equation 3 can be assumed. Expanding the cos term in equation 3 yields:

$$\tau_d = m_u \cdot g \cdot r_u \cdot \cos(\alpha) \cdot \cos(\phi_u) \cdot \cos(\theta_d) + m_u \cdot g \cdot r_u \cdot \cos(\alpha) \cdot \sin(\phi_u) \cdot \sin(\theta_d) + J_d \cdot p(\omega_d) + B_d \cdot \omega_d + \tau_c \, \mathrm{signum}(\omega_d) \quad (15)$$

It will be noticed that Equation 15 is of the same form as the inertia model given by Equation 14, with $A = m_u \cdot g \cdot r_u \cdot \cos(\alpha) \cdot \cos(\phi_u)$ and $B = m_u \cdot g \cdot r_u \cdot \cos(\alpha) \cdot \sin(\phi_u)$. Essentially, this embodiment uses the same procedure as calculating the inertia using a Parameter Estimator in the previous embodiment, except that in addition to calculating inertia, the unbalance mass can be extracted from the A and B parameters because the axis of the drum essentially remains fixed. The method for calculating $m_u$ from A and B above is the same method as that described in the second half of the previous embodiment.

Figure 14:
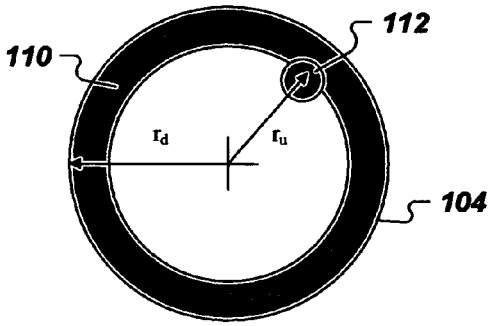
FIG. 14 conceptually shows a washing machine drum containing laundry and an unbalance mass.

As noted above, peak inertial torque ripple will be determined by $J_d$ for a given speed ripple, and the gravitational torque ripple will be determined by $m_u$ assuming that $r_u$ can be calculated before hand. FIG. 14 conceptually shows a washing machine drum 104 containing laundry 110 and an unbalance mass 112. In calculating the unbalance radius $r_u$, it is assumed that the laundry 110 is distributed as shown in FIG. 14 with the unbalance 112 acting at the inner radius formed by the evenly distributed laundry 110.

The inertia of the laundry 110 can be calculated by subtracting the empty drum inertia from $J_d$:

$$J_1 = J_d - J_{empty_drum}$$

The inertia of the laundry will be approximately equal to:

$$J_1 = \frac{m_1}{2}(r_d^2 + r_u^2)$$

where $m_1$ is the laundry mass.

The volume of the laundry is approximately equal to:

$$V_1 = 1\pi(r_d^2 - r_u^2)$$

where '1' is the length of the drum. Assuming a figure for the density of modern fabrics, $D_1$, the mass of the laundry can be written as:

$$m_1 = D_1 V_1$$

$r_u$ is therefore given by the following equation $$r_u = \sqrt[4]{r_d^4 - \frac{2J_1}{D_1 1\pi}}$$

(It is anticipated that $D_1$ will depend upon the type of laundry to be washed, e.g. synthetics, woolens, etc. will each have its own density).

In another embodiment of the present invention, the problem of having an "insufficiently excited" system is solved by introducing a "dither" signal to sufficiently excite all modes of the system. In the context of the system under investigation, this involves adding a signal to the speed command signal 202 such that the actual drum speed fluctuates around a mean value in a deterministic manner.

One requirement of the dither signal is that it should be of reasonably small amplitude so that the drum speed does not deviate too much from its mean value. Another requirement of the signal is that it should not excite any system resonances that could result in excessive vibration.

As described above, one of the reasons why the inherent speed ripple may not sufficiently excite all modes of the system is because its frequency is equal to that of the mean drum speed. For low values of speed ripple, this means that the unbalance torque and inertial torque are both approximately sinusoidal at the same frequency and the parameter estimator could therefore have difficulty in distinguishing between the two torque components. However, if the drum ripple contained frequency components of a different frequency to that of the mean drum speed, the unbalance and inertial components of torque would also differ in frequency and would therefore be more easily identifiable by the parameter estimator.

One of the benefits of using a dither signal to excite the system over the embodiments described previously is that unbalance mass and inertia can be calculated simultaneously at a substantially constant drum speed. Therefore, during unbalance detection the mean drum speed can be fixed at a speed to allow the use of the fixed axis model given by Equation 3, or if torque ripple due to viscous friction is assumed negligible, Equation 12 may be used. No particular form of dither signal is required, though in certain implementations, a 1 Hz sinusoidal dither signal with an amplitude of about 0.2 rad/s was used with satisfactory results.

As noted herein above, detecting the amount of a load unbalance allows the spin speed to be optimized to give an efficient wash and also minimizes the vibrations caused by centrifugal unbalance forces. To further improve efficiency, it is desirable to optimize the length of the spin cycle. Rather than simply operate a spin cycle for some predetermined time period, the spin cycle lasts until the water is removed from the laundry contained in the drum.

Accordingly, in accordance with further aspects of the present disclosure, the memory 108 stores program instructions executed by the processor 109 for detecting the proper time to end the spin cycle. In certain embodiments, the spin cycle is initiated upon completion of a drum unbalance detection process as described herein above. The unbalance detection may be run near the minimum plaster speed (about 80-100 rpm, for example). Further, to minimize vibrations due to drum unbalances, the spin speed may be selected based on the amount of unbalance. Once the amount of drum unbalance has been quantified, the drum 104 is then accelerated up to the desired spin speed.

For example, in one system considered, the drum 104 is run at a maximum spin speed of about 1154 rpm if the unbalance mass detected is less than 0.7 kg. If the unbalance mass is more than 2.5 kg, the spin speed is clamped at around 650 rpm. If the amount of unbalance is too high to run at a suitable spin speed the processor 109 is programmed to shake the drum 104 in order to redistribute the laundry.

As water is removed from the laundry during the spin process, the mass of the laundry reduces, resulting in a system that is non-linear, i.e., it is characterized by a set of changing parameters. Towards the end of a spin cycle, the amount of water loss from the laundry will be minimal and the system will approach a linear state where all its parameters are virtually constant. Therefore, monitoring the changes of the system parameters during the spin cycle using a suitable parameter estimator provides a good indication of when the spin cycle can be stopped.

A suitable parameter to monitor in determining the end of a spin cycle (when to command the motor 106 to stop spinning the drum 104) is the total drum inertia, including the laundry contained therein. Tests on towels indicate that the mass of the "wrung" laundry is about 60% of its saturated mass. The drum inertia should therefore decrease significantly throughout the spin cycle, regardless of how the laundry is distributed around the periphery of the drum 104. Other parameters will also change during the spin cycle, such as the unbalance mass and radius, and parameters relating to the suspension, but the amount by which they change will depend upon the amount of unbalance, which could be negligible. Such parameters are therefore not suitable for tracking purposes with regard to detecting the end of a spin cycle.

One method of tracking parameter changes is to carry out parameter estimation during the spin cycle in a piecemeal fashion, whereby estimates are taken over short time frames at regular points during the spin cycle. During the short interval when an estimate takes place the system is assumed to be linear, i.e. constant parameters, which is a reasonable assumption if estimation takes place over just several drum cycles. The parameter estimates are then compared with the previous estimates to get a measure of the amount by which the parameters are changing.

Another method of tracking parameter changes is to run a parameter estimation scheme continually "on-line" during the spin cycle until it has deemed to have finished by the automatic detection process. Any recursive estimator employed to estimate parameters must therefore be adaptive to the changing system parameters during the spin cycle. In an exemplary implementation, parameter estimation during the spin cycle is be done at the constant, mean spin speed using the moving axis model. To get the recursive estimator to track parameter changes, a forgetting factor technique is employed. More specifically, a technique known as "directional forgetting" is used to avoid problems with "estimator wind-up" (a known problem associated with the use of forgetting factors) in the exemplary embodiment disclosed.

As shown in FIGS. 5-6 and 14, the distribution of the laundry 110 can be approximated as an evenly distributed load with a point unbalance mass 112. During the spin cycle, water is extracted from the laundry 110, which will cause the mass of the laundry $m_1$ to decrease. This will tend to reduce the inertia of the laundry 110. On the other hand, as water is wrung out of the laundry 110, centrifugal forces will plaster the laundry 110 to the drum surface more, which will cause a reduction in volume V, and hence, an increase in the inner radius $r_u$. This will tend to increase inertia. However, it is expected that the reduction in laundry mass 110 will be the overriding effect on laundry inertia: a wet towel weighs considerably more than a dry one, but doesn't occupy significantly more volume. Therefore, an overall reduction in inertia $J_1$ is expected.

The unbalance mass 112 will almost certainly decrease, but it will also be affected by a slight change in laundry distribution as centrifugal forces compress the laundry 110 more during the spin cycle. This may also result in a small change in the unbalance mass angle $\phi_u$. A decrease in the unbalance mass 112 will result in a decrease in the unbalance inertial and centrifugal forces that cause the drum 104 to move on its suspension. However, since the total mass of laundry will also decrease, the total mass supported by the suspension will be less and will therefore, generally speaking, require less force to accelerate it.

During the spin cycle, the drum 104 will be commanded to run at a constant speed, which is determined by the amount of unbalance in certain embodiments. However, due to a combination of the unbalance torque ripple and the less than ideal response of the speed controller, there typically will be some speed variation of the drum 104 about its commanded or mean value.

Because inertia (unbalance mass) has to be estimated at a substantially constant drum speed, there may be insufficient inertial torque information for the estimator to get a good estimate of inertia $J_d$, particularly if there is very little speed ripple. Moreover, if the speed ripple is mainly composed of a component of the same frequency as the mean drum speed, the estimator may have difficulty in distinguishing between the inertial and unbalance torque components. In other words, when a constant drum speed is commanded, the system may not be sufficiently excited enough to allow an accurate estimate of inertia to be obtained.

As detailed herein above for detecting the drum unbalance, to sufficiently excite the system, a dither signal may be employed so that the estimator will find it easier to distinguish the inertial torque component from the unbalance torque. Various types of dither signals may be adopted; for example, the dither signal may be a sinusoidally varying signal that is added to the speed reference signal. Its purpose is to cause the drum speed to vary by a small amount about the commanded spin speed in a manner that persistently excites the system.

In the disclosure above regarding estimating the amount of unbalance 112, the drum torque, $\tau_d$, of a "fixed axis" drum 104 (drum is fixed in space—does not move on its suspension) inclined at $\alpha$ to the horizontal is given by Equation 3, which is repeated below.

$$\tau_d = m_u \cdot g \cdot r_u \cdot \cos(\alpha) \cdot \cos(\theta_d - \phi_u) + J_d \cdot p(\omega_d) + B_d \cdot \omega_d + \tau_c \cdot \text{signum}(\omega_d) \quad (3)$$

As noted above, $r_u$=radius at which the unbalance mass acts (m)

g=gravitational constant (9.81 m/s$^2$)

$\theta_d$=drum shaft position (rad)

$\phi_u$=position of unbalance mass with respect to an arbitrary drum reference (rad)

$J_d$=total drum inertia, including laundry (kg·m$^2$)

$\omega_d$=angular drum speed (rad/s)

p=differential operator, d/dt $B_d$=coefficient of viscous friction (Nm·rad/s)

$\tau_c$=coulomb friction (Nm)

Figure 15:
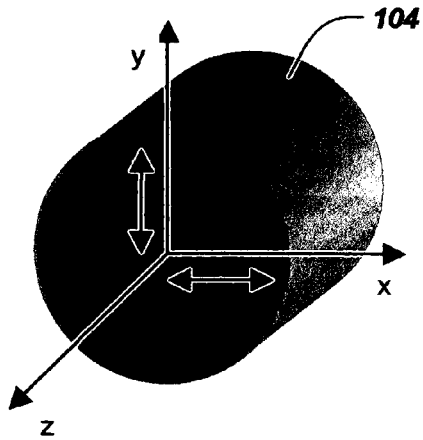
FIG. 15 conceptually shows a washing machine drum.

At spin speeds encountered in a typical horizontal axis washing machine, it is likely that any unbalance centrifugal force will be sufficient to cause the drum 104 to move on its suspension. For an approximately constant drum speed, the force, and hence the acceleration, of the center of the drum 104 will vary approximately sinusoidally at the drum frequency in the x and y plane as shown in FIG. 15. When the drum center accelerates in this manner, the effect on the drum torque is to introduce a second harmonic torque plus an offset torque. For brevity it will be assumed that movement in the z-plane will only have a second order effect on torque and will therefore be neglected.

The moving axis model for an approximately constant drum speed is therefore of the form:

$$\tau_d = m_u \cdot g \cdot r_u \cdot \cos(\alpha) \cdot \cos(\theta_d - \phi_u) + J_d \cdot p(\omega_d) + B_d \cdot \omega_d + \tau_c \cdot \text{signum}(\omega_d) + B \cdot \cos(2 \cdot \theta_d - \phi_s) + \tau_{susp} \quad (16)$$

where:

B=$2^{nd}$ harmonic amplitude $\tau_{susp}$=offset torque due to suspension movement $\phi_s$=$2^{nd}$ harmonic phase lag Equation 16 is essentially Equation 3 with an additional second harmonic term and an additional constant term. As the laundry dries out in the spin cycle, the reduction in laundry mass will cause the overall suspended mass, i.e., the drum mass, to reduce and also the centrifugal force. Therefore, although the suspended mass will become lighter, making it easier to accelerate, the force causing the acceleration will also reduce.

The drum speed can therefore be split into two components as follows:

$$\omega_d = \overline{\omega}_d + \omega_{d_ripple} \quad (17)$$

where $\overline{\omega}_d$=mean drum speed $\omega_{d_ripple}$=drum speed ripple component Using Equation 17, the viscous friction term in Equation 16 can be expanded to give:

$$\tau_d = m_u \cdot g \cdot r_u \cdot \cos(\alpha) \cdot \cos(\theta_d - \phi_u) + J_d \cdot p(\omega_d) + B_d \cdot \omega_{d_ripple} + B \cdot \cos(2 \cdot \theta_d - \phi_s) + \tau_{d_mean} \quad (18)$$

where $\tau_{d_mean} = \tau_c \text{signum}(\omega_d) + B_d \cdot \overline{\omega}_d + \tau_{susp}$=constant In general the viscous friction coefficient is small and the speed controller is designed to keep the speed ripple down to a minimum—ideally no more than a few percent of mean drum speed. The torque ripple due to viscous friction can therefore be neglected in most cases to give $$\tau_d = m_u \cdot g \cdot r_u \cdot \cos(\alpha) \cdot \cos(\theta_d - \phi_u) + J_d \cdot p(\omega_d) + B \cdot \cos(2 \cdot \theta_d - \phi_s) + \tau_{d_mean} \quad (19)$$

For the purposes of parameter estimation Equation 19 is expanded to give:

$$\tau_d = m_u \cdot g \cdot r_u \cdot \cos(\alpha) \cdot \cos(\phi_u) \cdot \cos(\theta_d) + m_u \cdot g \cdot r_u \cdot \cos(\alpha) \cdot \cos(\phi_u) \cdot \sin(\theta_d) + J_d \cdot p(\omega_d) + B \cdot \cos(\phi_s) \cdot \cos(2 \cdot \theta_d) + B \cdot \sin(\phi_u) \cdot \sin(2 \cdot \theta_d) + \tau_{d_mean} \quad (20)$$

Equation 20 can be written in the following form suitable for Parameter Estimators such as the RLS estimator:

$$y = x^T \theta \quad (21)$$

where $$y = \tau_d$$

$$x^T = [\cos(\theta_d) \quad \sin(\theta_d) \quad p(\omega_d) \quad \cos(2 \cdot \theta_d) \quad \sin(2 \cdot \theta_d) \quad 1] \quad (22)$$

-continued $$\theta = \begin{bmatrix} m_u \cdot r_u \cdot g \cdot \cos(\alpha) \cdot \cos(\phi_u) \\ m_u \cdot r_u \cdot g \cdot \cos(\alpha) \cdot \sin(\phi_u) \\ J_d \\ B \cdot \cos(\phi_s) \\ B \cdot \sin(\phi_s) \\ \tau_{d_mean} \end{bmatrix} = \begin{bmatrix} P_1 \\ P_2 \\ P_3 \\ P_4 \\ P_5 \\ P_6 \end{bmatrix} \quad (23)$$

and $P_{1\text{-}6}$ are the parameters, or coefficients, estimated by the PE.

Assuming that the drum torque is given by Equation 20, the system parameters are given by Equation 23. During the spin cycle, these parameters will change as a result of water being removed from the laundry by centrifugal force. In order for a parameter estimator such as a recursive least squares estimator to track these parameter changes, the estimator must be adaptive to parameter variation. There are several techniques that enable a parameter estimator to become adaptive. A suitable technique is the use of a forgetting factor.

The forgetting factor gives the parameter estimator the ability to adapt to parameter changes by reducing the emphasis the estimator places on past information. The forgetting factor, $\lambda$, can be interpreted as a forgetting time constant with a data memory roughly equal to $(1-\lambda)^{-1}$.

In general, the ability of the parameter estimator to accurately track parameter changes increases as the amount of forgetting is increased, i.e., as $\lambda$ is reduced. However, this is not to say that one can arbitrarily set $\lambda$ to a very low value to "be on the safe side" and assume that the estimator will have good tracking capability regardless of how the parameters change. It is therefore important to understand the factors influencing the choice of $\lambda$ if satisfactory results are to be obtained.

If the estimator is only working on the last "data points remembered" (DPR) number of data points, then the data within that span of data points must not change too significantly if an accurate estimate is to be obtained. This means that less forgetting (high $\lambda$) is required for systems where the rates of change of system parameters are small. Conversely, if the rates of change of system parameters are high, then it is likely that accurate estimates are only obtainable with lower values of $\lambda$. The choice of forgetting factor is therefore determined by a combination of the sampling rate and the rate of change of parameters.

Given that the rate of change of parameters with time is the significant factor in the determination of $\lambda$, it is more convenient, and meaningful, to think of $\lambda$ in terms of "time remembered" (TR), rather than the number of DPR. TR is simply DPR multiplied by the sampling time:

$$TR = \tau_s \cdot (1-\lambda)^{-1} \quad (24)$$

If the TR is too small, then not enough information, with respect to time, is available for the estimator to get an accurate estimate.

In general, it can be stated that the end of the spin cycle occurs when the drum inertia has settled down to a reasonably constant value. This suggests that in using the inertia parameter to detect the end of the spin cycle, it is appropriate to monitor the rate of change of the drum inertia. In this way, the end of a spin cycle can be defined as being the point when the rate of change of inertia approaches a predetermined value close to zero.

Figure 16:
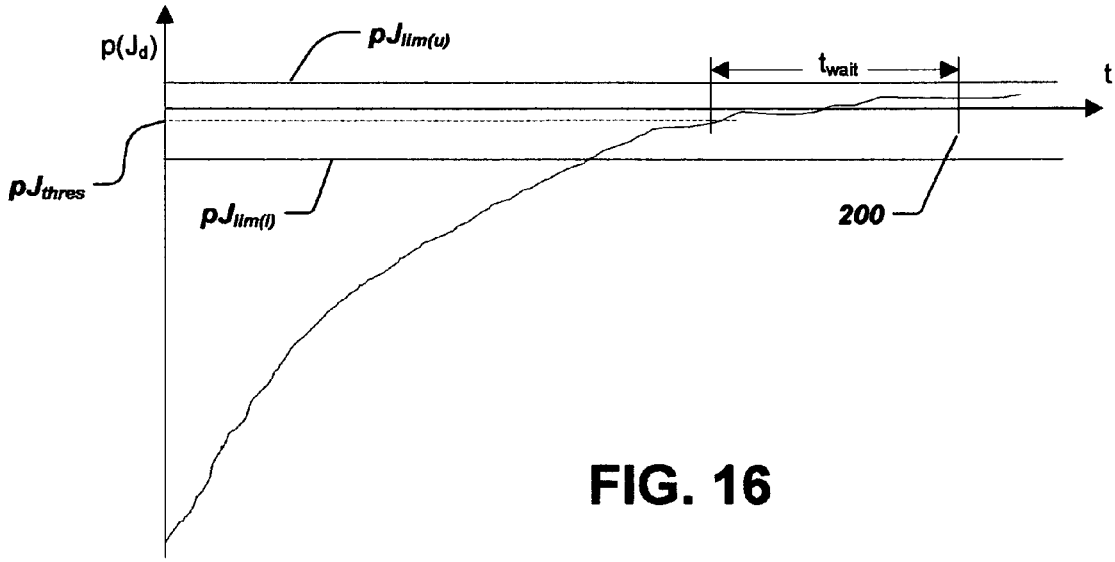
FIG. 16 is a graph illustrating the rate of change of inertia during the washing machine spin cycle.

FIG. 16 shows one method of identifying the end of a spin cycle using the rate of change of inertia. Because the inertia of the drum generally decreases during the spin cycle, the rate of change of inertia will be negative during the majority of the spin cycle. As water is extracted from the laundry, the rate of change of inertia will approach zero. If the rate of change of inertia rises above a specified threshold, $pJ_{thres}$, and stays within the limits, $pJ_{lim(u)}$ and $pJ_{lim(1)}$ for a time period $t_{wait}$, the spin cycle is deemed to have finished.

Figure 17:
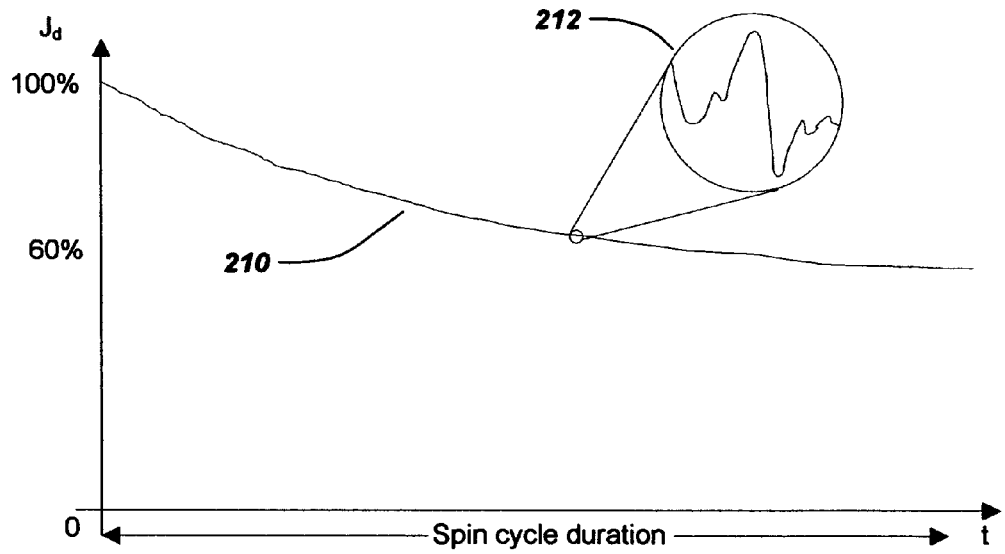
FIG. 17 is a graph illustrating inertia change during a spin cycle.

FIG. 17 shows the general trend of inertia 210. Over the time period of a spin cycle, the rate of change of inertia is quite low, as the spin cycle may last several minutes or more, and the inertia 210 of the laundry will reduce by no more than around 40%. However, over a smaller time span, say a drum cycle, the rate of change of the inertia estimate could be quite high due to small, but higher frequency, variations around the general trend 212.

The differentiation process is a good amplifier of noise, so when the inertia estimate 210 is differentiated, the result may contain so much noise that the rate of change of the general trend will not be identifiable. Filtering may be employed to overcome this problem. Because the rate of change of inertia is low when taken over the duration of a spin cycle, it is possible to heavily filter the signal without causing any significant phase distortion of the estimate's general trend. Any higher frequency components on the inertia estimate can be reduced significantly by employing filters with low cut-off frequencies and relatively high orders.

Alternatively a gain, G, can be incorporated in the differentiation process such that the rate of change of inertia, $pJ_d$, is approximated as follows:

$$pJ_d \approx \frac{pJ_d}{1 + pJ_d / G} \quad (25)$$

At low frequencies the approximation given by Equation 25 is accurate, whereas at high frequencies the gain is limited to G. G is typically in the range 3 to 20. Equation 25 can be discretised for digital implementation by any of the standard methods such as the Tustin Transformation.

Another method of addressing the issue of a noisy estimate derivative is to effectively re-sample the inertia estimate at a lower rate before differentiation takes place. Because the inertia changes gradually over the course of a spin cycle, it is not necessary to calculate its derivative at the relatively high rates of sampling that are required by the estimator to get an accurate estimate of inertia $J_d$. For example, if the inertia is estimated at a rate of 1 ms, it may only be necessary to consider every $1000^{th}$ inertia estimate when calculating $p(J_d)$, which is effectively the same as resampling the data at 1 s. Moreover, this method could be used in conjunction with filtering.

In other embodiments, the spin cycle end is detected by using the raw inertia estimate only. Prior to the spin cycle being detected, an estimate of drum inertia and an approximate calculation of the unbalance radius is obtained as part of the unbalance detection process at around 100 rpm. Using a representative figure for the reduction in mass of the laundry, which can be obtained by experiment and stored in the memory 108, it is possible to calculate what the inertia should be at the end of the spin cycle. This value is then used as a "target" value for determining the completion of the spin cycle. When the inertia drops below the projected value and stays within specified limits for a specified period of time, the spin cycle is deemed to have completed.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of controlling a spinning washing machine drum, the method comprising:

spinning the drum;

monitoring a predetermined parameter of the spinning drum; and stopping the drum in response to the monitored parameter, wherein the predetermined parameter is inertia, and wherein the monitoring thereof includes determining the combined inertia of the drum and the contents of the drum by fluctuating variables of the drum about predetermined values.

2. The method of claim 1, wherein monitoring the predetermined parameter includes:

determining a first value for the predetermined parameter;

determining a second value of the predetermined parameter; and determining the change in the parameter between the first and second values.

3. The method of claim 1, wherein monitoring the predetermined parameter includes continuously monitoring the parameter until the desired change.

4. The method of claim 1, wherein monitoring the predetermined parameter includes using a parameter estimator.

5. The method of claim 4, wherein parameter estimator is a recursive least squares estimator.

6. The method of claim 5, wherein the parameter estimator is adaptive to parameter changes.

7. The method of claim 1, wherein determining the combined inertia includes spinning the drum at a substantially constant mean speed.

8. The method of claim 1, wherein determining the combined inertia includes fluctuating the drum speed about a predetermined speed value.

9. The method of claim 8, wherein fluctuating the drum speed includes applying a speed demand signal to a speed controller, and applying a dither signal to the speed demand signal.

10. The method of claim 1, wherein monitoring the predetermined parameter includes monitoring the rate of change of the predetermined parameter.

11. The method of claim 10, wherein stopping the drum in response to the monitored predetermined parameter includes stopping the drum in response to the rate of change reaching a predetermined value.

12. The method of claim 11, wherein stopping the drum in response to the monitored predetermined parameter includes stopping the drum in response to the rate of change staying within a predetermined range for a predetermined time period.

13. The method of claim 1, further comprising detecting a drum unbalance in response to the predetermined parameter.

14. The method of claim 13, further comprising quantifying the drum imbalance in response to the predetermined parameter.

15. The method of claim 14, flirt her comprising selecting the drum spin speed in response to the detected drum imbalance.

16. The method of claim 13, wherein the drum spins about an axis, and wherein detecting the drum unbalance includes monitoring movement of the drum axis.

17. The method of claim 16, wherein the predetermined parameter is inertia.

18. A program storage device storing program code implementing a method of determining a load unbalance mass contained in a spinning washing machine drum driven by a motor, the method comprising:

spinning the drum;

monitoring at least one predetermined parameter of the spinning drum; and stopping the drum in response to the at least one monitored parameter;

wherein the at least one predetermined parameter includes the inertia of the spinning drum, and wherein the monitoring thereof includes determining the combined inertia of the drum and the contents of the drum by fluctuating variables of the drum about predetermined values.

* * * * *